US005314513A

United States Patent [19]

Miller et al.

[11] Patent Number: 5,314,513

[45] Date of Patent: May 24, 1994

[54] ABRASIVE PRODUCT HAVING A BINDER COMPRISING A MALEIMIDE BINDER

[75] Inventors: Philip Miller, St. Paul; Eric G. Larson, Lake Elmo, both of Minn.; Don H. Kincaid, Hudson, Wis.

[73] Assignee: Minnesota Mining and Manufacturing Company, St. Paul, Minn.

[21] Appl. No.: 953,302

[22] Filed: Sep. 28, 1992

Related U.S. Application Data

[63] Continuation of Ser. No. 845,016, Mar. 3, 1992, abandoned.

[51] Int. Cl.[5] ..... B24D 11/00

[52] U.S. Cl. ..... 51/295; 51/293; 51/298; 51/309; 428/365; 428/383; 428/395; 526/262

[58] Field of Search ..... 51/293, 295, 298, 308, 51/309; 526/262; 428/365, 383, 395

[56] References Cited

U.S. PATENT DOCUMENTS

| | | | |
|---|---|---|---|
| 2,958,593 | 11/1960 | Hoover et al. | 51/295 |
| 3,650,715 | 3/1972 | Beushek et al. | 51/298 |
| 3,651,012 | 3/1972 | Holub et al. | 260/47 UA |
| 3,718,447 | 2/1973 | Hibbs, Jr. et al. | 51/295 |
| 3,839,287 | 10/1974 | Kwiatkowaki et al. | 260/49 |
| 3,963,458 | 6/1976 | Gladstone et al. | 51/295 |
| 4,100,140 | 7/1978 | Zahir et al. | 526/90 |
| 4,107,125 | 8/1978 | Lovejoy | 260/37 N |
| 4,142,870 | 3/1979 | Lovejoy | 51/298 |
| 4,240,807 | 12/1980 | Kronzer | 51/295 |
| 4,575,384 | 3/1986 | Licht et al. | 51/293 |
| 4,684,678 | 8/1987 | Schultz et al. | 523/466 |
| 4,729,771 | 3/1988 | Kunimoto et al. | 51/298 |
| 4,735,632 | 4/1988 | Oxman et al. | 51/295 |
| 4,744,802 | 5/1988 | Schwabel | 51/309 |
| 4,904,801 | 2/1990 | Butler et al. | 548/521 |
| 4,923,928 | 5/1990 | Boyd et al. | 525/117 |
| 4,964,883 | 10/1990 | Morris et al. | 51/293 |
| 5,011,508 | 4/1991 | Wald et al. | 51/293 |

FOREIGN PATENT DOCUMENTS

| | | | |
|---|---|---|---|
| 55-17057 | 5/1980 | Japan | C08L 35/00 |

OTHER PUBLICATIONS

Recent Advances in Thermosetting Polyimides, Stenzenberger, British Polymer Journal 20 (1988) pp. 383-396.

Chemical Abstract No. 104:6825k, Abrasaive Tools, p. 47, 1986.

Derwent Publication 92-424001C51, 1992.

Japanese Patents Gazette, Week Y32, Sep. 1977.

Patent Abstract of Japan, vol. 15, No. 461, Nov. 1991.

Patent Abstracts of Japan, vol. 15, No. 85, Feb. 1991.

Japanese Patents Abstracts, Week 9105, Mar. 1991.

*Primary Examiner*—Mark L. Bell

*Assistant Examiner*—Willie J. Thompson

*Attorney, Agent, or Firm*—Gary L. Griswold; Walter N. Kirn; Janice L. Dowdall

[57] ABSTRACT

The present invention relates to an abrasive article comprising:

(a) a flexible substrate having a front side and a back side;

(b) at least one layer of abrasive grains bonded to said front side of said substrate by means of a make coat;

(c) optionally one or more additional coats selected from the group consisting of a size coat, a supersize coat, a saturant coat, a presize coat, and a backsize coat;

wherein at least one of said make, size supersize, saturant, presize, and backsize coats comprises a maleimide binder. The invention also relates to a method of making the abrasive articles.

20 Claims, 1 Drawing Sheet

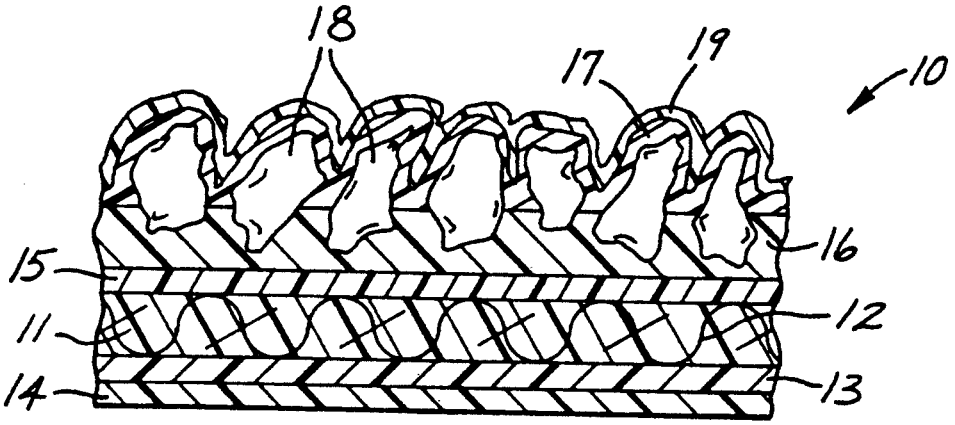
Fig. 1
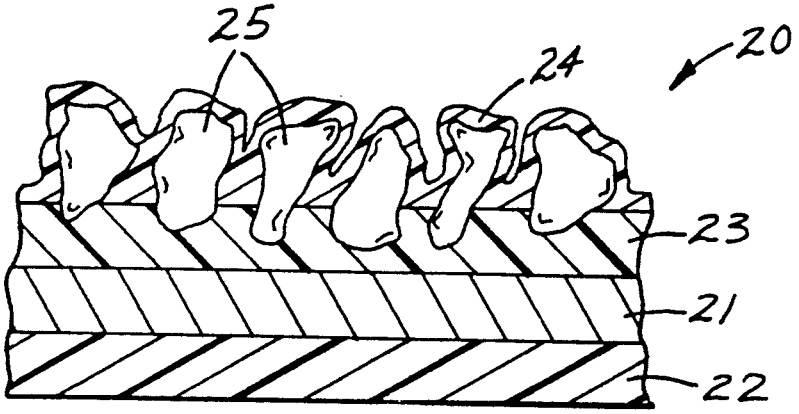
Fig. 2
Fig. 3
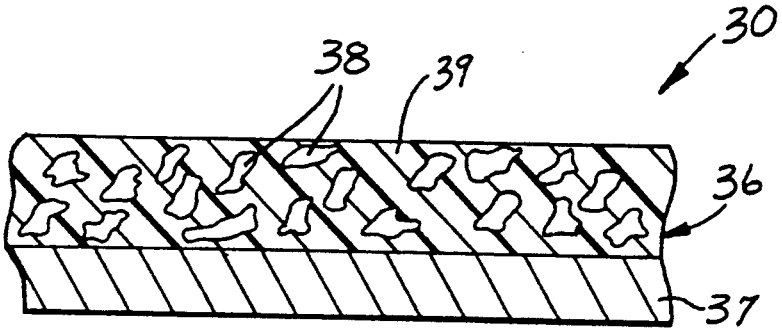
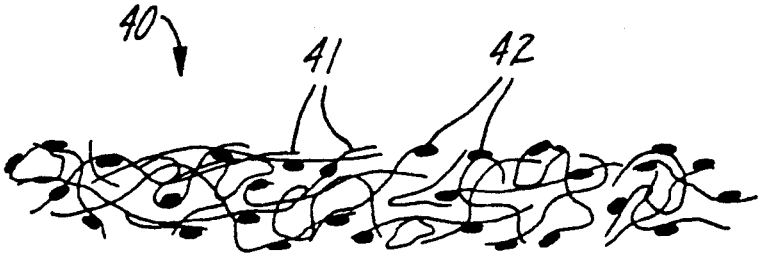
Fig. 4

ABRASIVE PRODUCT HAVING A BINDER COMPRISING A MALEIMIDE BINDER

This is a continuation of application Ser. No. 07/845,016 filed Mar. 3, 1992, now abandoned.

FIELD OF THE INVENTION

This invention relates to flexible abrasive products having a resinous binder which bonds abrasive grains to a substrate which has improved performance under dry and wet grinding conditions and at high temperatures.

BACKGROUND OF THE INVENTION

Flexible abrasive articles include coated abrasives, lapping abrasives, and nonwoven abrasives. In the case of a coated abrasive the substrate is a backing sheet. In the case of a nonwoven abrasive the substrate is a flexible open lofty porous web. In the case of lapping abrasives, the substrate is a backing.

Coated abrasives generally comprise a flexible backing sheet upon which a binder holds and supports a coating of abrasive grains. The coated abrasive may employ a "make" coat of resinous binder material in order to secure the abrasive grains to the backing as the grains are oriented, and a "size" coat of resinous binder material which can be applied over the make coat and abrasive grains in order to firmly bond the abrasive grains to the backing. The binder material of the size coat can be the same material as the binder material of the make coat or a different material.

In the manufacture of coated abrasives, the make coat and abrasive grains are first applied to the backing, then the size coat is applied, and finally, the construction is fully cured. Generally thermally curable binders provide coated abrasives with excellent properties, e.g., heat resistance. Thermally curable binders include phenolic resins, urea-formaldehyde resins, urethane resins, melamine-formaldehyde resins, epoxy resins, and alkyd resins. The most widely used binder is a resol phenolic resin.

In recent years, there has been an increasing demand for superabrasives both in the flexible and bonded abrasive markets. Superabrasives are abrasive articles that employ abrasive grains that are superior in performance, i.e., greater than 20 times that of conventional abrasive grains in abrading difficult to grind materials such as tool steels or ceramics. Superabrasive grains are typically diamond or cubic boron nitride and these abrasive grains typically cost in excess of one thousand dollars per pound. Conventional abrasive grains include garnet, silicon carbide, silica, aluminum oxide, alumina zirconia, boron carbide, and ceramic aluminum oxide. Conventional abrasive grains are typically less than ten dollars per pound.

For bonded abrasives, if superabrasive grains are employed, the binders can be vitreous, organic, or metallic (plated or sintered). While each binder type has a specific area of application, the relative strength of the binder materials is generally from strongest to weakest 1) metallic 2) vitreous and 3) organic. As a result, optimum abrasive retention and thus performance is usually achieved with metallic binders.

It is very difficult, however, to make flexible abrasive articles capable of optimum performance using metallic or vitreous binders. This is due to the processing temperatures associated with these binders. Some conventional substrates used in manufacturing flexible abrasive articles will degrade at temperatures greater than about 200° C. Additionally, the metallic and vitreous binders tend to be more rigid than organic binders. This rigidity is normally not desired in a flexible abrasive article. In order to employ superabrasive grains in a flexible abrasive article, a resinous binder, such as a phenolic resin, is employed. However, phenolic resins do not always have the necessary properties to obtain the full utilization of the superabrasive grains. Thus, it is not cost effective to use superabrasive grains and consequently, superabrasive grains are not widely used in flexible abrasive articles.

U.S. Pat. No. 3,651,012 (Holub et al.) discusses a bismaleimide binder for use as insulation, protective applications and numerous molding applications. In column 13, line 33 to 45 it mentions that the bismaleimide binder can be used in bonded abrasives.

U.S. Pat. No. 4,107,125 (Lovejoy) concerns a crosslinked aromatic polyimide resin that exhibits good strength and toughness properties. This patent mentions that this resin can be employed in a bonded abrasive article.

U.S. Pat. No. 4,142,870 (Lovejoy) discloses a bonded abrasive having a combination of two linear polyimide resins as a binder.

U.S. Pat. No. 4,575,384 (Licht et al.) discloses that polyimide binders can be employed in a coated abrasive.

U.S. Pat. No. 4,729,771, (Kunimotot et al.) involves a polyimide binder for a flexible abrasive lapping film.

However, none of these references disclose a maleimide resin as a binder for a flexible coated abrasive or a method of making such an abrasive article.

A need thus exists for a flexible coated abrasive with an improved resinous binder especially for superabrasive containing constructions. The binder should possess a high degree of strength at high temperatures and under wet conditions, a high glass transition temperature, and a high modulus.

SUMMARY OF THE INVENTION

We have discovered a novel flexible abrasive article comprising a substrate bearing abrasive grains adhered thereto. A maleimide containing resinous binder precursor is used which can be cured to produce a flexible abrasive article with improved performance under dry and wet grinding conditions and at high temperatures. The maleimide binder flexible abrasive article can outperform premium phenolic resinous binder abrasive articles in a number of applications, particularly wet applications at medium to high pressure (i.e., about 10 to about 30 kg/cm$^2$).

The flexible abrasive article comprises:

(a) a flexible substrate having a front side and a back side;

(b) at least one layer of abrasive grains bonded to said front side of said substrate by means of a make coat;

(c) optionally one or more additional coats selected from the group consisting of a size coat, a supersize coat, a saturant coat, a presize coat, and a backsize coat, wherein at least one of said make, size, supersize, saturant, presize, and backsize coats comprises a maleimide binder.

The method of making the flexible abrasive article of the invention comprises the steps of:

(a) coating a front side of a flexible substrate having a front side and a back side with a make coat precursor;

(b) applying at least one layer of abrasive grains onto the make coat precursor;

(c) at least partially curing the make coat precursor by exposing the make coat precursor to an energy source;

(d) coating a liquid size coat precursor over the abrasive grains and the at least partially cured make coat;

(e) curing the size coat precursor and the at least partially cured make coat, if needed, by exposure to an energy source in order to form a fully cured abrasive article;

wherein at least one of the make coat precursor and the size coat precursor comprises a maleimide binder. Preferably the make coat and size coats each comprise liquids. Preferably, the energy source emits heat to cure the coatings.

The substrate has a front and back side. The front side contains the coating of abrasive grains. In the case of a coated abrasive and a lapping abrasive, the substrate comprises a backing. The term "backing" as used herein refers to substrates such as cloth, paper, polymeric film, vulcanized fiber, nonwoven materials, combinations thereof, and treated versions thereof. In the case of a nonwoven abrasive, the substrate comprises a random nonwoven web comprising fibers. The fibers themselves may be coated with a binder such as a thermosetting resin to hold the web together better. Examples of such thermosetting resins include phenolic resins, epoxy resins, acrylate resins, melamine resins, aminoplast resins, polyurethane resins, and polyurea resins. The substrate may have a backsize coat of a binder on the back side of the substrate. The substrate may have a saturant coat of binder which saturates the substrate. The term "saturant coat" as used herein refers to a resin which saturates the backing, typically cloth, resulting in a stiffer substrate. The substrate may have a presize coat of a binder coated on the front side of the substrate. The term "presize coat" as used herein refers to a coating adding bulk to the substrate or sealing the coating surface and improving adhesion of subsequently applied coats such as a make coat. The flexible abrasive article of the invention will have a make coat which serves to secure the abrasive grains to the substrate. The flexible abrasive article of the invention may have a size coat applied over the abrasive grains which serves to reinforce the abrasive grains. The flexible abrasive article of the invention may optionally have a supersize coat applied over the size coat. The purpose of the supersize coat is to improve the abrading efficiency of the abrasive article. The flexible abrasive article of the invention contains a maleimide binder in either the backsize coat, the saturant coat, the presize coat, the make coat, the size coat, the supersize coat or combinations thereof.

The following definitions are used throughout. The term "precursor" is defined as the resinous type material prior to polymerization into a crosslinked, insoluble state. The "precursor" used in the article of the present invention comprises a maleimide resin. The terms "precursor", "binder precursor", and "coat precursor" are used interchangeably throughout. During the manufacture of the abrasive article, the precursor comprising the maleimide resin is in a substantially uncured or unpolymerized state. During the manufacturing process, the precursor is exposed to an energy source which, along with an optional initiator, ultimately initiates the polymerization or curing of the maleimide resin. After the polymerization or curing step, the maleimide is no longer an oligomeric material or a monomeric material, or mixtures thereof, but a thermoset polymer or binder or coat. The terms "curing" and "polymerization" are used interchangeably throughout. The terms "curing" and "polymerization" are both defined herein as the increase in molecular weight of the resin(s) such that the resin(s) is no longer soluble in an organic solvent.

There are three major embodiments of the invention. In the first embodiment, which is the preferred embodiment, the precursor comprises a bismaleimide resin of the following formula:

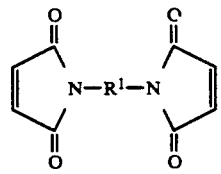

STRUCTURE A wherein $R^1$ comprises a divalent organic group, such as those selected from the group consisting of aliphatic, cycloaliphatic, and aromatic groups.

In the second embodiment the precursor comprises a maleimide resin of the formula:

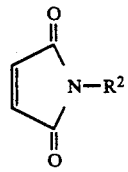

STRUCTURE B wherein $R^2$ comprises a monovalent organic group, such as those selected from the group consisting of aliphatic, cycloaliphatic, and aromatic groups.

In the third embodiment the precursor comprises a maleimide resin of the formula

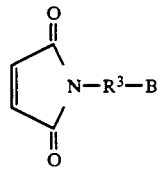

STRUCTURE C wherein $R^3$ comprises a divalent organic group, such as those selected from the group consisting of aliphatic, cycloaliphatic, and aromatic groups; and B comprises a polymerizable group.

BRIEF DESCRIPTION OF THE DRAWINGS

FIG. 1 illustrates in cross section a coated abrasive article having a cloth backing.

FIG. 2 illustrates in cross section a coated abrasive article having a paper backing.

FIG. 3 illustrates in cross section a lapping abrasive article having a paper backing.

FIG. 4 illustrates in cross section a nonwoven abrasive article.

DETAILED DESCRIPTION

The present invention relates to flexible abrasive articles that contain a maleimide binder as part of one or more of the following: cloth treatments (such as a saturant coat, presize coat, or backsize coat), a make coat, a size coat, and a supersize coat. A flexible abrasive article is defined as a flexible substrate having abrasive grains secured thereto. There are three major types of flexible abrasive articles—coated abrasive articles, nonwoven abrasive articles, and lapping abrasive articles.

For coated abrasive articles and lapping abrasive articles the flexible substrate comprises a flexible backing including but not limited to those selected from the group consisting of paper, metallic plates, cloth, nonwoven fibrous sheets, vulcanized fibre, polymeric films, combinations thereof, and treated versions thereof. In the case of a metallic plate, the thickness of the plate is less than about 1 cm, preferably less that about 0.5 cm and most preferably less than about 0.2 cm. Examples of treatments for the flexible substrates include phenolic resins, epoxy resins, acrylate resins, latices, glue, starch, polyamide resins, and urea-formaldehyde. Treatments can also include fillers such as calcium carbonate, clay, and silica.

For nonwoven abrasive articles the abrasive grains are secured to a flexible open porous nonwoven web. The nonwoven web can be made from synthetic filaments such as polyester and nylon. Nonwoven abrasive articles in general are further described in Hoover, U.S. Pat. No. 2,958,953, incorporated herein by reference.

The abrasive grains used in the flexible abrasive articles of the invention can be selected from the group consisting of fused aluminum oxide, ceramic aluminum oxide, heat treated aluminum oxide, silicon carbide, alumina zirconia, ceria, garnet, diamond; boron carbide, cubic boron nitride, silicon nitride, and mixtures thereof. Preferably, the abrasive grains used are selected from the group consisting of diamond, cubic boron nitride, and mixtures thereof for reasons of better utilization of the premium mineral. A diluent such as glass, marble, greystone, etc. can be added. Diluents typically have a particle size ranging from about 50 to about 1000 micrometers. If used, the weight ratio of diluent to abrasive grain typically ranges from about 0:100 to about 90:10, preferably from about 20:80 to about 90:10.

The binders typically employed in flexible abrasive articles differ from those typically employed in bonded abrasives, i.e. grinding wheels. In flexible abrasive articles the weight ratio of binder to abrasive grain is typically about 60:40 to about 25:75. In bonded abrasive articles this weight ratio is typically on the order of about 20:80 to about 35:65. Thus, in general, the binder employed in a flexible abrasive article has a much greater role at the grinding interface than a bonded abrasive article. Flexible abrasive articles are made in a continuous web process in which the binder precursors are applied in a liquid form. Bonded abrasive articles are made in a batch molding process in which the binder precursors are applied primarily in a powdered form and cured under pressure. Bonded abrasive binder precursors are cured to a completely rigid state and as such generally do not flex during abrading. As a result, the bonded abrasive binders can be very hard and can contain high levels of abrasive grain for maximum rigidity. In contrast, some means for flexibility must be incorporated into the flexible abrasive binders either through flex cracking or through tough flexible binders. By flex cracking the cured, rigid belt is made "flexible" by bending around a small radius to introduce long cracks perpendicular to the length of the belt. The mineral is secured in "islands" of cured resin bonded to cloth backing. If the resin was too brittle, the islands would be too small to effectively hold the mineral to the backing. The flexible abrasive binders must be able to adhere not only to the abrasive grains but also to the substrate or treatment on the substrate. Bonded abrasive binders do not need to provide for chip clearance, it can be dressed into the bonded abrasive. Coated abrasive bonds must provide for chip clearance and still have the necessary adhesion properties to secure the abrasive grains to the substrate during use. "Chip clearance" refers to the space between the top of the mineral (cutting edge) and the top of the binder. The mineral in a bonded abrasive is fully encapsulated in the resin; coated abrasive mineral protrudes from the surface of the binder.

Flexible abrasive articles of the invention that comprise a maleimide binder of the invention are illustrated in FIGS. 1 through 4.

As illustrated in FIG. 1, the flexible abrasive article 10, which is a coated flexible abrasive article, has a cloth substrate 12. The cloth substrate 12 has been saturated with a saturant coat 11. Additionally, the cloth substrate 12 has been treated with an optional first backsize coat 13 on one side and an optional presize coat 15 on the opposite side. There is no clear line of demarcation between the backsize coat and the presize coat which meet in the interior of the cloth backing. In some instances it may be desirable that a second backsize coat 14 be applied over the first backsize coat 13. Overlaying the presize coat 15 is a make coat 16 in which are embedded abrasive grains 18. A size coat 17 has been placed over the make coat 16 and the abrasive grains 18. In some instances it may be desirable that there be a second size coat, commonly referred to as a supersize coat 19 applied over the size coat 17. In metal grinding, the supersize coat may comprise a resinous adhesive and a grinding aid. In paint sanding, the supersize coat may comprise a loading resistant coating such as zinc stearate which prevents the coated abrasive from filling with the paint that has been abraded.

In FIG. 2 there is illustrated a coated abrasive generally indicated as 20 which is formed on a paper substrate 21. A back treating coat 22 is applied on one side of paper substrate 21. The paper substrate is overcoated on the opposite side with a make coat 23 in which is embedded abrasive grains 25. The abrasive grains 25 and make coat 23 are overcoated with a size coat 24 which aids in holding the abrasive grains 25 onto the backing.

In FIG. 3 there is illustrated a lapping flexible abrasive article generally indicated as 30 which is formed on a paper substrate 37. On the front side of the substrate is an abrasive coating 36 comprising a plurality of abrasive grains 38 distributed throughout a make coat 39.

In FIG. 4 there is illustrated a nonwoven flexible abrasive article generally indicated as 40. There are a plurality of abrasive grains 42 distributed throughout an open, lofty, porous, polymer filament substrate 41. The abrasive grains 42 are secured to the nonwoven substrate by means of a make coat.

In the first embodiment of the invention, which is the preferred embodiment, the precursor comprises a bismaleimide resin of the following formula:

STRUCTURE A

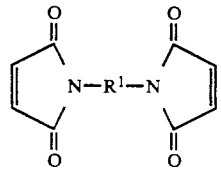

wherein $R^1$ comprises a divalent organic group, such as those selected from the group consisting of aromatic, aliphatic, cycloaliphatic, heteroaromatic, and heterocyclic groups. Examples of useful heterocyclic groups are those heterocyclic groups comprising 4 to 5 carbon atoms and at least one atom selected from the group consisting of N, O, and S atoms as part of the ring structure. Useful $R^1$ groups typically have a number average molecular weight ranging from about 70 to about 1200, preferably about 100 to about 600, and most preferably, about 100 to about 500. $R^1$ typically comprises about 6 to about 50 carbons. If the molecular weight of $R^1$ is too high, a high viscosity solution results which requires higher amounts of solvent to reach coatable viscosities and consequently increased cure times to remove the additional solvent. If the molecular weight of $R^1$ is too low, the solubility is usually poor and the cured resin is usually too brittle. It is preferred that $R^1$ comprise an aromatic group in order to provide better thermal performance and superior hardness. $R^1$ can optionally be substituted. Suitable substituent(s) are those that do not inhibit or prevent polymerization of the bismaleimide resin. Examples of suitable substituents include $C_{1-8}$ alkyl groups (e.g., methyl, ethyl, propyl, butyl, etc.), aryl (e.g., phenyl, naphthyl), allyl, halogens, hydroxy, nitro, alkoxy, teitiary amino, and carbonyl groups. Primary amino, secondary amino, and thiol substituents would not be suitable since they would interfere with polymerization. Examples of $R^1$ groups include but are not limited to those selected from the group consisting of:

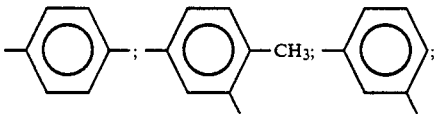

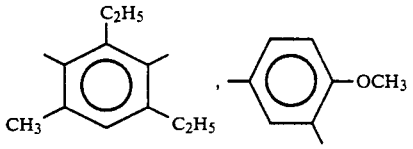

$(CH_2)_n$ where n is an integer of about 1 to about 20;

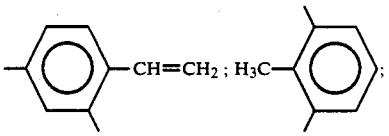

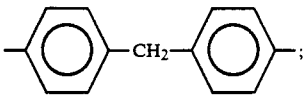

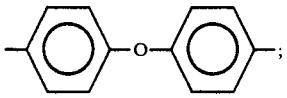

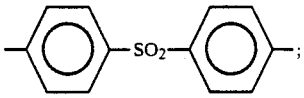

-continued

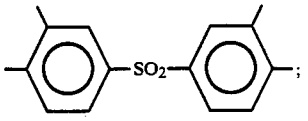

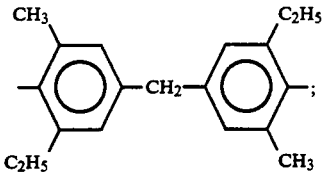

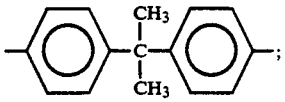

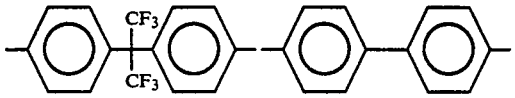

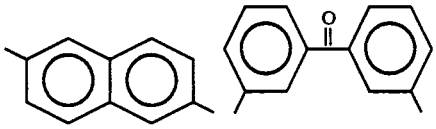

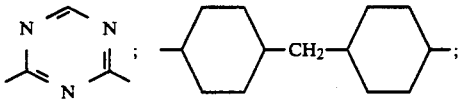

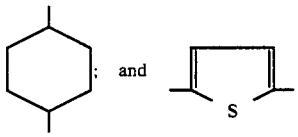

A preferred $R^1$ is represented by STRUCTURE D below

STRUCTURE D

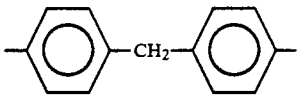

wherein the bismaleimide would be 4,4'-bismaleimididodiphenylmethane which is commercially available as Matrimid TM 5292A from Ciba Geigy. Examples of bismaleimide resins having the STRUCTURE A include the Matrimid TM resins available from Ciba Geigy, the Compimide TM resins available from Shell, and the Kerimide TM resins available from Rhone Poulenc. Bismaleimide resins falling within STRUCTURE A are preferred due to their commercial availability and the excellent performance of binders prepared therefrom under both wet and dry grinding conditions.

In general terms, the bismaleimide resin of the first embodiment can be synthesized by the reaction of maleic acid anhydride with an aromatic diamine. Typically, the aromatic diamine is first reacted with maleic anhydride at room temperature in an inert organic solvent. Examples of useful inert organic solvents include but are not limited to those selected from the group consisting of toluene, dichloroethane, chloroform, methylene chloride, and mixtures thereof. The reaction forms the corresponding bismaleamic acid as an intermediate product. The intermediate product then undergoes cyclodehydration to form the maleimide resin. This reaction typically takes place at temperatures ranging from about 35° C. to about 100° C. with acetic anhydride ($Ac_2O$) and fused sodium acetate (NaOAc) catalyst present. An organic solvent is typically present in order to facilitate mixing and thus reaction. This type of synthesis is illustrated in Reaction I.

REACTION I

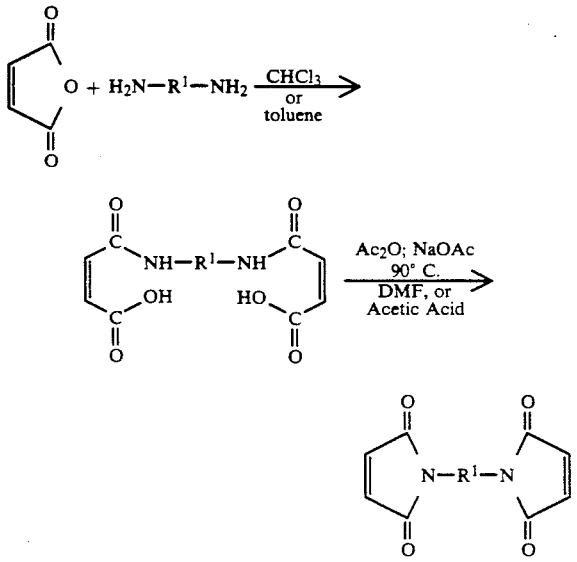

Reaction II is a one step method of preparing bismaleimide resin.

REACTION II

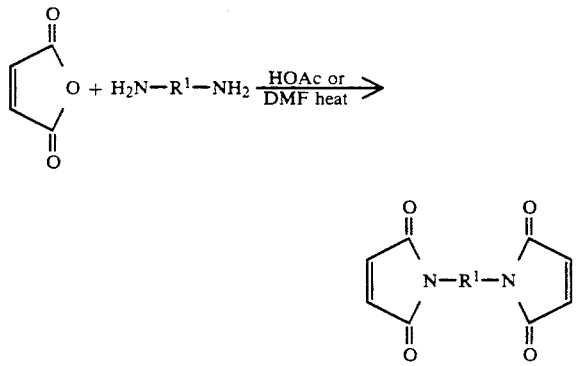

The solvent utilized is typically dimethyl formamide (DMF) or toluene. Acetic acid (HOAc) can also be used as a solvent. U.S. Pat. No. 4,904,801, incorporated by reference herein, describes an improved method of bismaleimide synthesis. U.S. Pat. No. 3,839,287, incorporated by reference herein, describes a method of synthesis of aryl ether bismaleimides.

In the second embodiment of the article of the invention, the precursor comprises a compound of the formula:

STRUCTURE B

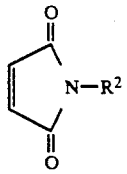

wherein $R^2$ comprises a monovalent organic group selected from the group consisting of aromatic, aliphatic, and cycloaliphatic groups. $R^2$ typically comprises about 2 to about 20 carbon atoms. Examples of groups $R^2$ can comprise include but are not limited to the following: ethyl, propyl, hexyl, cyclohexyl, phenyl, and naphthyl. $R^2$ has a number average molecular weight ranging from about 70 to about 1200, preferably about 100 to about 600, and most preferably about 100 to about 500. It is preferred that $R^2$ comprises an aromatic group. $R^2$ can optionally be substituted. Suitable substituent(s) are those that do not inhibit or prevent polymerization of the maleimide resin. Examples of suitable substituents include $C_{1-8}$ alkyl groups (e.g., methyl, ethyl, propyl), aryl (e.g, phenyl, naphthyl), alkoxy, hydroxy, tertiary amino, nitro, halogens, and carbonyl groups. Primary amino, secondary amino, and thiol substituents would not be suitable since they would interfere with polymerization. Examples of specific $R^2$ groups include those selected from the group consisting of

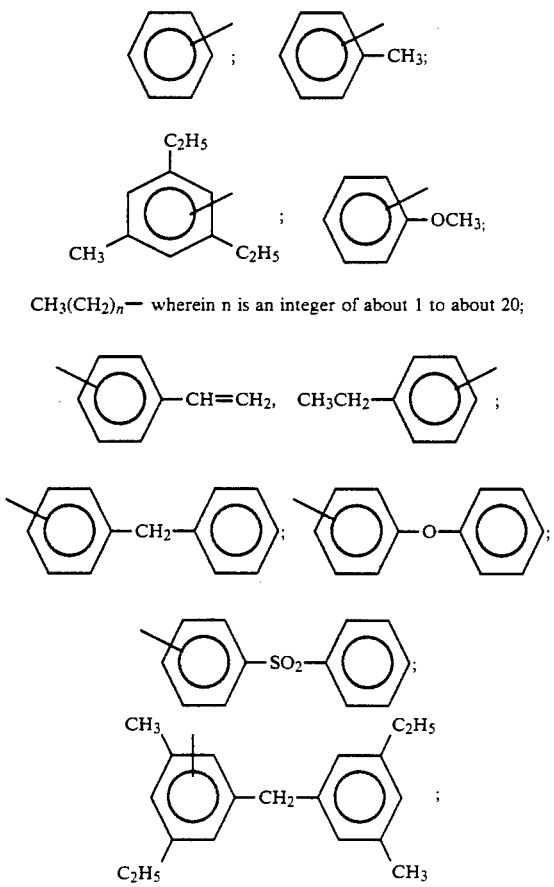

-continued

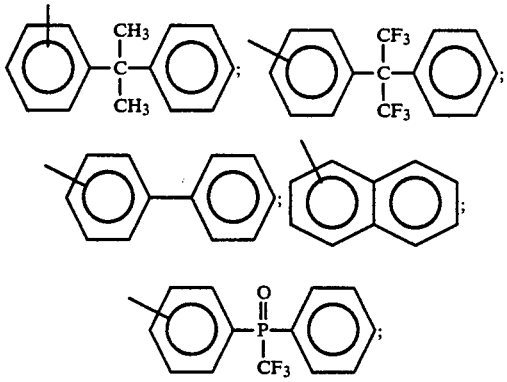

and mixtures thereof.

In the third embodiment of the invention, the precursor comprises a compound of the formula:

STRUCTURE C

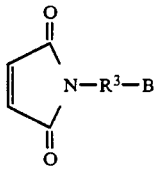

wherein $R^3$ comprises an organic divalent group selected from the group consisting of aromatic, aliphatic, and cycloaliphatic groups and B is a polymerizable group. Useful $R^3$ groups typically have a number average molecular weight ranging from about 70 to about 1200, preferably about 100 to about 600, most preferably about 100 to about 500. If the molecular weight of $R^3$ is too high, a high viscosity solution results, which requires higher amounts of solvent to reach coatable viscosities and consequently increased cure times to remove the additional solvent. If the molecular weight of $R^3$ is too low, the solubility is usually poor and the cured resin is usually too brittle. $R^3$ typically comprises about 1 to about 30 carbon atoms, preferably about 6 to about 20 carbon atoms. It is preferred that $R^3$ comprises an aromatic group in order to provide a cured binder having better modulus, heat resistance, glass transition temperature (Tg), and moisture resistance. $R^3$ can optionally further comprise one or more substituents. Suitable substituents include those that do not inhibit or prevent polymerization of the maleimide resin. Typical examples of substituents include alkyl groups comprising about 1 to about 8 carbons (e.g., methyl, ethyl), aryl (e.g., phenyl, naphthyl), allyl, hydroxy, tertiary amino, halogens, alkoxy, nitro, and carbonyl groups. Primary amino, secondary amino, and thiol substituents would not be suitable since they would interfere with polymerization. B represents any type of reactive or polymerizable organic group such as a free radically reactive unsaturated group. B can also comprise an OH or an epoxy group. B can comprise an unsaturated group capable of undergoing addition polymerization with suitable initiation. Examples of such groups include those selected from the group consisting of alpha beta unsaturated carbonyl groups, acetylene groups, vinyl groups, vinyl ethers, vinyl esters, and allyl groups. B can thus react with other maleimide resins or with other resinous adhesives. It is preferred that B is an unsaturated group that is capable of reacting with other resins containing unsaturated groups such as acrylate resins. Examples of specific groups which $R^3$ can comprise include but are not limited to the following: cyclohexylene, ethylene, methylene, phenylene, diphenyl methane, and 2,2-diphenyl propane.

Other examples of $-R^3-B$ are listed below as STRUCTURES E-K.

STRUCTURE E

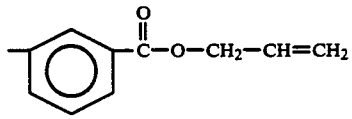

STRUCTURE F

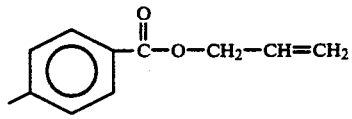

STRUCTURE G

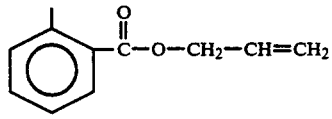

STRUCTURE H

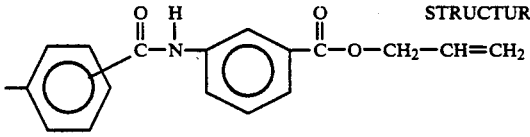

STRUCTURE I

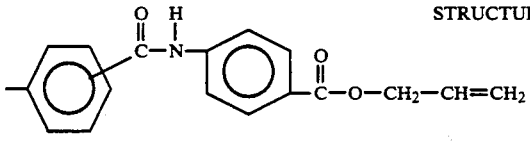

STRUCTURE J

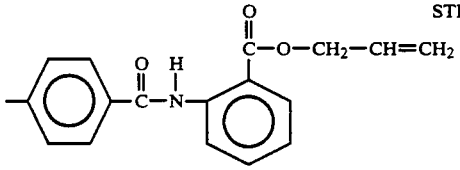

STRUCTURE K

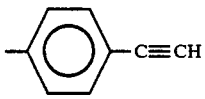

The maleimide resins useful in the second and third embodiments can be synthesized by the following methods. For STRUCTURES E, F, and G, the corresponding aminophenylcarboxylic acid can be esterified with an allyl alcohol. The resulting aminobenzoic acid allyl ester can then be condensed with maleic anhydride. For STRUCTURES H, I, and J, the aminobenzoic acid allyl ester can be reacted with N-maleimide benzoyl chloride to yield the corresponding maleimide ally benzoate ester.

The precursor of the invention, in addition to comprising the maleimide resin, may further comprise reactive diluent(s) which may be copolymerized with the maleimide ring. If used, the reactive diluent typically comprises about 5 to about 50 weight percent, preferably about 10 to about 40 weight percent of the binder precursor. These reactive diluents can generally be described by the following formula:

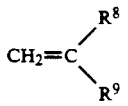

STRUCTURE L wherein:

$R^8$ is selected from the group consisting of —H, —$CH_2CH_3$, —$CH_3$, and aromatic groups such as those selected from the group consisting of phenyl, naphthyl, and biphenyl groups; and $R^9$ is selected from the group consisting of aliphatic groups comprising about 1 to about 25 carbon atoms and cyclic structures comprising 5 and 6 membered ring structures. The ring structures are generally aromatic. The rings may be heteroaromatic or contain only carbon. Examples of such ring structures include pyrrolyl, thiophenyl, phenyl, pyridyl, and the like. Preferred ring structures are aromatic or heteroaromatic.

Examples of reactive diluents of STRUCTURE L are typically of the vinyl, allyl, or aryl type. Specific examples of such reactive diluents include those selected from the group consisting of vinylpyridine, vinylpyrrolidinone, vinylphenylether, diallyether, methallylether, styrene, methylstyrene, vinylhexane, vinylcyclohexane, divinylbenzene, divinyl cyclohexane, diallylbenzene, vinyltoluene, 4-vinyl-4-ethyl-benzene, and mixtures thereof. Preferred structures are those wherein $R^8$ is —H and $R^9$ is selected from the group consisting of aromatic and heterocyclic groups, in order to obtain a cured binder having a higher modulus and higher Tg.

Further information on maleimide resins can be found in Horst Stenzenberger's "Recent Advances in Thermosetting Polyimides" *British Polymer Journal,* Volume 20, 1988, pp. 383 to 396, incorporated hereinafter by reference. Examples of commercially available maleimide resins include Compimide TM resins available from Shell Chemical, Houston, Tex.; Kerimide TM resins available from Rhone Poulenc; and Matrimid TM resins available from Ciba-Geigy.

The maleimide resin polymerizes via one of several mechanisms. The polymerization occurs through the double bonds of the imide rings to create the polymer network. The reactivity of the maleimide resin is associated with the electron withdrawing nature of the double bonds present in the imide rings. The two adjacent carbonyl groups have an electron withdrawing nature which creates a very electron poor bond. The initiator will initiate the polymerization of the maleimide resin when the binder precursor is exposed to an energy source.

The polymerization mechanism for maleimide resins is different than that for polyimide resins. Polymerization of the maleimide resins occurs (through the double bonds) via reaction of vinyl groups. In contrast, polyimide resins polymerize via a condensation mechanism in which water is given off.

Maleimides are thermosetting, and when crosslinked, produce an insoluble and infusible resinous network. These crosslinked maleimide resins of the invention have high strength, dimensional stability, heat resistance, and absence of cold flow. The maleimide binders typically have a high glass transition temperature under both wet and dry abrading conditions.

The polymerization of the maleimide resin can occur via one of several different mechanisms which include but are not limited to ionic homopolymerization, ionic copolymerization, nucleophilic addition, free radical addition, and Diels-Alder addition. For ionic polymerization, a tertiary amine, diazabicylo-octane or imidazole, is employed as a catalyst. For free radial polymerization, a free radical initiator may be employed. The terms "initiator", "curing agent", and "catalyst" are used interchangeably herein. Examples of useful free radical initiators include but are not limited to those selected from the group consisting of peroxides, azo compounds, benzophenones, quinones, and mixtures thereof. Examples of peroxides include dicumyl peroxide, benzoyl peroxide, cumene hydroperoxide, and di-t-butyl peroxide. An example of an azo compound is azobisisobutyronitrile. About 0.1 to about 2 weight percent of an initiator is used based upon the weight of the cured resin.

Illustrated in Reaction III is a nucleophilic addition curing mechanism in which a bismaleimide resin is reacted with an aromatic diamine.

REACTION III

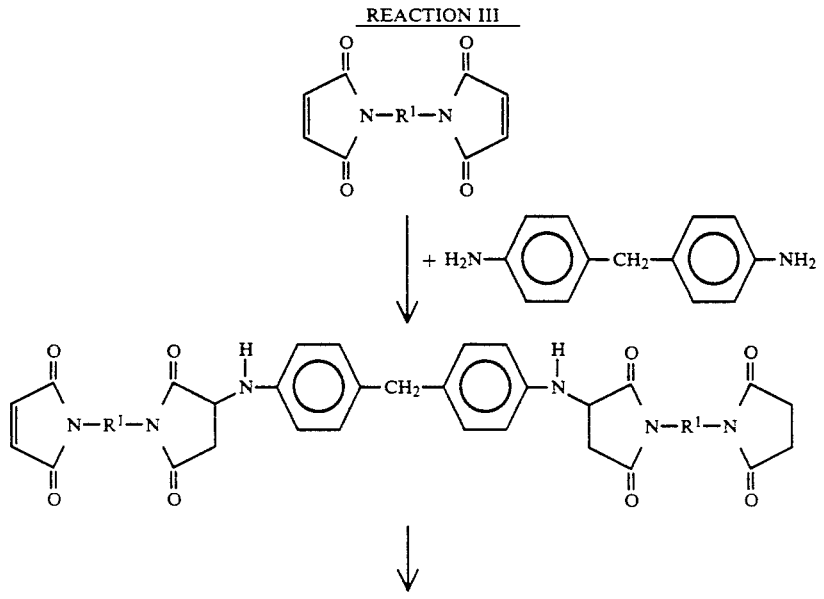

-continued

REACTION III

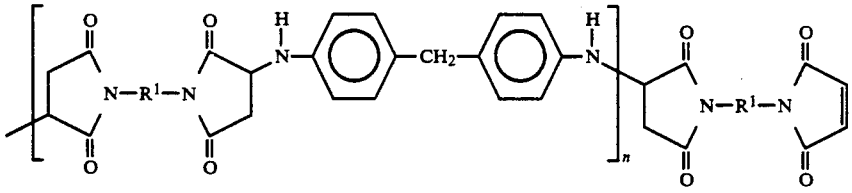

The polymerization via a Diels-Alder mechanism is illustrated in Reaction IV. A bis(propenylphenoxy) compound reacts with the maleimide resin at a temperature generally in the range of about 170° C. to about 230° C.

REACTION IV

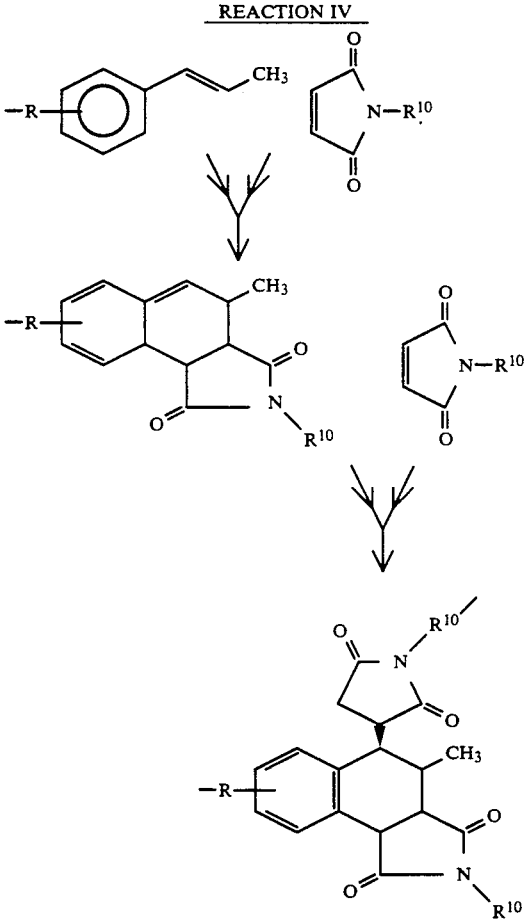

In the reaction sequence above, R comprises the residue of a reactive diluent of Structure L and $R^{10}$ comprises the residue of the maleimide of Structure A, B, or C. It is also possible that the maleimide resin copolymerizes with a curable resin including but not limited to those selected from the group consisting of allylesters, acrylates, styrenes, triallylcyanurate, triallylisocyanurate, diallylphthalate, and mixtures thereof. This is illustrate below as Reaction V in a free radical polymerization mechanism.

REACTION V

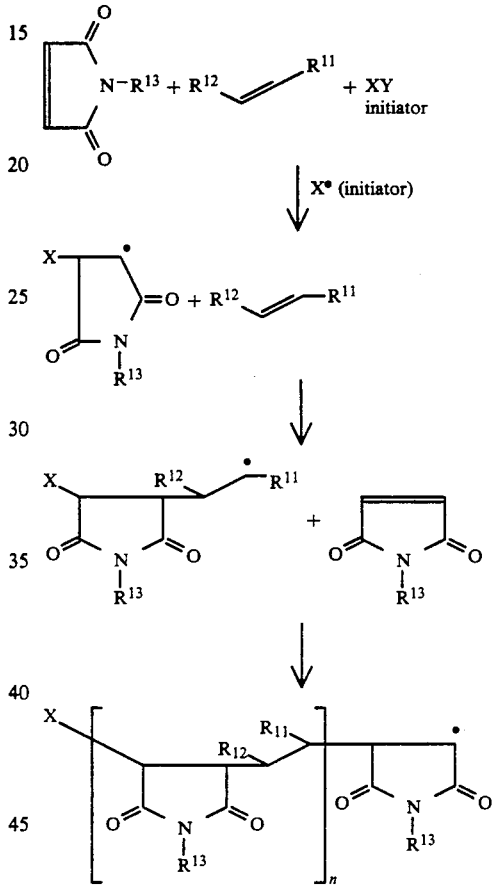

For the above reaction sequence $R^{13}$ comprises the residue of a maleimide, $R^{12}$ and $R^{11}$ comprise the residue of the curable resin and X comprises the residue of a free radical initiator.

It is preferred that the precursor be cured by exposure to heat. The oven temperature will typically range from about 100° C. to about 250° C. for about 15 minutes to about 16 hours. According to a preferred set of curing conditions, the temperature should be set at about 100° C. to about 150° C. for about 30 to about 120 minutes to allow any organic solvent or water to be driven off. Next, the precursor is cured for about 1 to 16 hours at about 200° C. The curing source (i.e., energy source) can be heat, electron beam, ultraviolet light, visible light, or combinations thereof. Heat is the preferred energy source and the thermal conditions are those as given above. Electron beam radiation, which is also known as ionizing radiation, can be used at an energy level of about 0.1 to about 10 Mrad, preferably at an energy level of about 1 to about 10 Mrad. When ultraviolet light or visible light are employed as the energy source, an initiator is required. Examples of initiators, that when exposed to ultraviolet light generate a free radical source, include but are not limited to those selected from the group consisting of organic peroxides, azo compounds, quinones, benzophenones, nitroso compounds, acryl halides, hydrazones, mercapto compounds, pyrylium compounds, triacrylimidazoles, bisimidazoles, chloroalkytriazines, benzoin ethers, benzil ketals, thioxanthones, and acetophenone derivatives, and mixtures thereof.

Ultraviolet radiation refers to non-particulate radiation having a wavelength within the range of about 200 to about 400 nanometers, preferably within the range of about 250 to about 400 nanometers. Visible radiation refers to non-particulate radiation having a wavelength within the range of about 400 to about 800 nanometers, preferably in the range of about 400 to about 550 nanometers. Examples of initiators, that when exposed to visible radiation generate a free radical source, can be found in U.S. Pat. No. 4,735,632, entitled "Coated Abrasive Binder Containing Ternary Photoinitiator System" (assigned to the assignee of the present case), incorporated herein by reference.

The rate of curing of the composition via exposure to a particular energy source varies according to the resin thickness as well as the density and nature of composition. The $R^1$, $R^2$ and $R^3$ moieties of STRUCTURES A, B, and C, respectively are essentially the backbone of the maleimide resin and they strongly influence the physical properties of the resulting, cured maleimide binder.

The precursor of the invention comprises a maleimide resin or a mixture of maleimide resins (i.e., a mixture of Structures A and/or B and/or C). However, the precursor can in addition comprise other resinous adhesives blended with the maleimide resin(s). Typically a resinous adhesive would be employed to control costs. These resinous adhesives include thermosetting resins and compounds which serve to modify the final properties of the maleimide binder.

Examples of such thermosetting resins and compounds include but are not limited to those selected from the group consisting of phenolic resins, epoxy resins, acrylate resins, latices, acrylic latices, urea-formaldehyde resins, melamine-formaldehyde resins, polyamide resins, polyimide resins, aminoplast resins, mixtures thereof, and the like. The thermosetting resins and/or chemical compounds blended with the maleimide resin should not interfere with the polymerization of the maleimide resin.

If included, the resinous adhesive typically comprises about 5 to about 80 percent by weight of the cured binder for reasons of cost, preferably about 5 to about 50 percent by weight in order to minimize impact on performance of the abrasive article, and most preferably about 5 to about 40 percent by weight in order to further minimize impact on performance of the abrasive article.

As discussed earlier, the binder precursor comprises a maleimide binder resin and optional additives. Suitable additives include those selected from the group consisting of fillers, toughening agents, fibers, lubricants, grinding aids, wetting agents, surfactants, pigments, dyes, coupling agents, plasticizers, suspending agents, mixtures thereof, and the like. The amounts of these materials are selected to give the properties desired.

Toughening agents can be included in the precursor comprising STRUCTURE A, STRUCTURE B, STRUCTURE C, or mixtures thereof to toughen the overall resin. Examples of suitable toughening agents include but are not limited to those selected from the group consisting of carboxyl terminated acrylonitrile butadiene rubber and amine terminated acrylonitrile butadiene rubber (both available from Goodrich under the trademark Hycar TM rubber), bis allyl aromatics such as bis allyl phenyl ether, and mixtures thereof. Additional examples of useful toughening agents include those described in U.S. Pat. Nos. 4,100,140 and 4,923,928, both incorporated by reference herein. Bis allyl aromatics are available from Shell Chemical Company under the tradenames Compimide TM 121 and 123, and are available from Ciba Geigy under the tradename Matrimid TM 5292 Part B. Matrimid TM 5292 Part B has the following structure:

STRUCTURE M

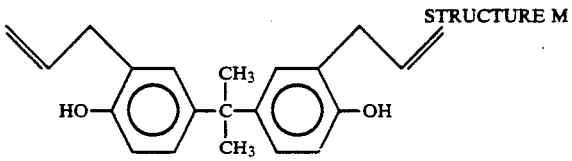

The precursor typically comprises about 2 to about 50 of weight percent of a toughening agent, if included, preferably about 5 to about 45 weight percent, most preferably about 10 to about 40 weight percent, based upon the total weight of cured resin. The term "cured resin" includes maleimide, catalyst, curing agent, initiator, other resins, toughening agent, and reactive diluent.

It is preferred to add a filler and/or grinding aid to the binder precursor. The filler and/or grinding aid are typically inorganic particles having particle sizes ranging from about 1 to about 50 micrometers. The fillers can be selected from any filler material which does not adversely affect the characteristics of the binder system. Examples of preferred fillers include those selected from the group consisting of calcium carbonate, silica, calcium metasilicate, mixtures thereof, and the like.

Examples of preferred grinding aids include those selected from the group consisting of cryolite, ammonium cryolite, potassium tetrafluoroborate, and mixtures thereof. The weight ratio of the cured resin to the total amount of filler and/or grinding aid will range from about 1:4 to about 4:1.

Fillers may be used at ranges from about 0 to about 75 weight percent, preferably about 40 to about 70 weight percent, based upon the total weight of the cured binder. Wetting agents, surfactants, coupling agents, dyes, and pigments, if used, are each typically included at ranges from about 0.02 to about 1 percent by weight, preferably about 0.05 to about 1 percent by weight, based upon the total weight of the cured binder. Plasticizer, if used, is typically included in amounts ranging from about 5 to about 40 weight percent, preferably about 5 to about 25 weight percent, based upon the total weight of the cured resin, for reasons of effectiveness.

Most commercially available maleimide resins are available as glassy, powdery solids. An example of such is Compimide TM maleimide resin commercially available from the Shell Chemical Company, Houston, Tex. In order to utilize maleimide resins in making abrasive articles, a hot melt processing or a solution processing technique can be utilized. The solution processing technique involves dissolving the powdery maleimide resin in an organic solvent to form a liquid dispersion or solution. It is preferred that as the maleimide resin is added to the solvent, the resulting dispersion or solution is heated between about 50° C. to about 150° C., more preferably about 90° C. to 120° C.

Examples of typical useful polar organic solvents include but are not limited to those selected from the group consisting of dimethylformamide, acetone, methyl ethyl ketone, dimethylacetamide, N-methylpyrrolidinone, ethyl acetate, methyl acetate, tetrahydrofuran, ethylene glycol diethyl ether, ethylene glycol dimethyl ether, dichloroethane and mixtures thereof.

Typically between about 5 to about 45%, preferably between about 15 to about 25% by weight solvent is added based upon the total weight of the cured resin. The amount of solvent ultimately depends upon the desired coating viscosity. If the maleimide resin is applied at an elevated temperature, then the amount of solvent in general can be reduced. Also the curing agent and the optional additives are added to the resin to form the binder precursor.

In the manufacture of a coated abrasive product, the binder precursor can be used as either a backsize coat, a saturant coat, a presize coat, a make coat, a size coat, a supersize coat, or combinations thereof. These various coating terms are well understood by those skilled in the art. If the maleimide binder is not employed as one of these coats, then a conventional binder can be employed. Examples of conventional resins include but are not limited to those selected from the group consisting of phenolic resins, urea-formaldehyde resins, melamine formaldehyde resins, latices, acrylate resins, epoxy resins, urethane resins, isocyanate resins, and mixtures thereof.

Coated abrasives will typically have a make and size coat, however the other coats (e.g. saturant, backsize, presize, supersize) are optional. Illustrated below is an example of how to make a coated abrasive article containing all the coats. First, the substrate is saturated with a saturant coat precursor by any conventional technique such as dip coating, roll coating, powder coating, or hot melt coating. The saturant coat precursor, the backsize coat precursor, the presize coat precursor, the make coat precursor, and the size coat precursor are dried or partially cured such that the coat is dry to the touch before the next coat is applied. This allows the next coat to be applied. After the saturant coat precursor is applied, the backsize or presize coat precursors are applied by any conventional technique such as roll coating, die coating, powder coating, hot melt coating, or knife coating. Next, the make coat precursor is applied over the presize by any conventional technique such as spray coating, roll coating, die coating, powder coating, hot melt coating, or knife coating. The abrasive grains are projected into the make coat precursor before the drying or partial curing. Typically the abrasive grains are projected by an electrostatic coating process. Then the size coat precursor is applied over the abrasive grains by any conventional technique. Finally, the supersize coat precursor is applied over the size coat by any conventional technique. After the last coat is applied, the binder precursor in the coated abrasive is finally cured.

In the manufacture of a lapping abrasive article, the substrate may be treated in the same manner as described above for the coated abrasive. However the abrasive grains are applied in a different manner. The abrasive grains are dispersed in a make coat precursor to form an abrasive slurry. The abrasive slurry is applied to the substrate by any conventional coating technique such as roll coating. Next, the make coat precursor is optionally dried and then cured to form the make coat.

In the manufacture of a nonwoven abrasive, the abrasive grains are first dispersed in a make coat precursor to form an abrasive slurry. The abrasive slurry is applied into the open porous lofty nonwoven substrate by any conventional coating technique such as roll coating. Next, the make coat precursor is optionally dried and then cured to form the make coat.

It should be noted that the curing temperature of the bismaleimide binder precursor should be such that it does not degrade the selected flexible substrate in the preparation of any abrasive article of the invention.

Copending concurrently filed U.S. application Ser. No. 07/845,214 entitled "THERMOSETTING BINDER FOR AN ABRASIVE ARTICLE", incorporated by reference herein, discloses a polycyclic aryl, polycyclic alkyl, and/or cycloalkyl modified epoxy resin having a high Tg and thermal resistance in an abrasive article. The copending application discloses several abrasive articles which can include the maleimide resin of the present invention in addition to the modified epoxy resin binder disclosed in the copending application.

The following non-limiting examples will further illustrate the invention. All parts, percentages, ratios, etc. in the examples and the rest of the specification are by weight unless otherwise indicated.

The following designations are used throughout the examples.

CMS—a calcium metasilicate filler which contains amino silane coupling agent (commercially available as Wollastokup TM filler from the Nyco Company).

CAO—a ceramic aluminum oxide abrasive grain described in U.S. Pat. Nos. 4,744,802 and 5,011,508, both incorporated by reference herein, consisting of 93.5% alpha alumina by weight, 4.5% MgO, and 2% iron oxide.

CAO[2]—a ceramic aluminum oxide abrasive grain described in U.S. Pat. Nos. 5,011,508; 4,744,802; and 4,964,883; all incorporated by reference herein, consisting of 99% alpha alumina and 1% iron oxide.

ER1—an epoxy resin, commercially available from the Dow Chemical Co. under the trade designation "DER 332".

PEI—polyetherimide, commercially available from General Electric under the trade designation "Ultem 1000".

SOL—an organic solvent, having the trade designation "Aromatic 10011", commercially available from Worum Chemical Co., St. Paul, Minn.

HPT 1079—fluorene containing epoxy resin commercially available from Shell Chemical Company.

Modifying Component A—a fluorene moiety containing curing agent for epoxy resin which is illustrated below.

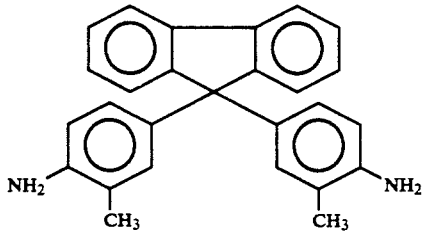

Modifying Component B—a fluorene moiety containing curing agent for epoxy resin which is illustrated below.

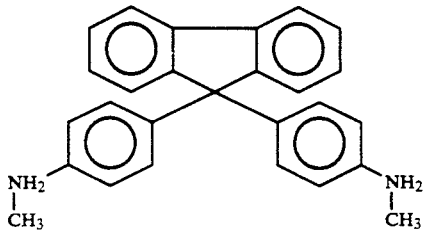

Modifying Component C—a fluorene moiety containing curing agent for epoxy resin which is illustrated below.

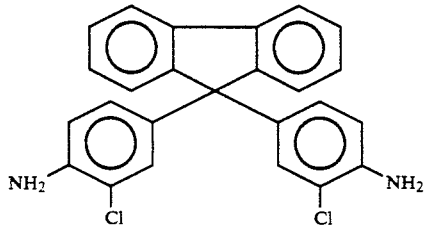

The preparation of modifying components A, B, and C is discussed in U.S. Pat. No. 4,684,678, incorporated by reference herein.

Preparation of Modifying Component A

Into a 500 ml pressure vessel the following ingredients were placed:

18.0 g fluorenone
107.0 g 2-methylaniline
5.6 g methanesulfonic acid

The vessel was sealed and heated to 175° C. for 24 hours. The water formed in the condensation reaction was retained in the vessel throughout the reaction. The vessel was cooled and its contents poured into 1 liter of methanol containing twenty grams of triethyl amine. The white crystalline product was filtered and washed with methanol until the effluent was colorless. 32 grams of crystals melting at 228° to 230° C. were recovered and identified by NMR spectroscopy analysis as 9,9-bis(3-methyl-4-aminophenyl)fluorene.

Preparation of Modifying Component B

Into a 500 ml 3-necked flask equipped with a Dean-Stark trap and means for flooding with nitrogen were placed: 22.5 g fluorene, 94.0 g N-methylaniline, 18.0 g concentrated hydrochloric acid.

A stream of nitrogen was introduced and the flask and its contents heated to I40° C. These conditions were maintained for 8 hours during which time water and condensate that collected in the Dean-Stark trap were removed.

The reaction mixture was then cooled to 90° C. and poured into a solution of 19 g triethyl amine in 350 g ethanol. The solution that was obtained was cooled to 10° C. and held at this temperature for 16 hours. The white crystals which formed were filtered off and washed with cold ethanol until the effluent was colorless. The white crystals obtained were vacuum dried at 100° C. for 16 hours. There was obtained 35 g of pure white crystals melting at 200° to 201° C. Analysis by NMR spectroscopy indicated that the crystals were bis(4-methylaminophenyl)fluorene.

Preparation of Modifying Component C

Into a 500 ml pressure vessel the following ingredients were placed: 20.0 g fluorenone, 142.5 g 2-chloroaniline, 5.3 g methanesulfonic acid.

The vessel was sealed and heated to 175° C. for 24 hours. The water formed in the condensation reaction was retained in the vessel throughout the reaction. The vessel was cooled and its contents poured into 1 liter of methanol containing twenty grams of triethyl amine. The white crystalline product was filtered and washed with methanol until the effluent was colorless. There was obtained 376 grams of a white powder melting at 198° C. to 200° C.

There was obtained 35 g of a crystalline compound melting at 196° to 198° C. identified by NMR spectrometry as 9,9-bis(3-chloro-4-aminophenyl)fluorene.

Example 1

A make coat binder precursor was prepared by thoroughly mixing at room temperature 26 parts of a bismaleimide resin (Compimide TM 796 commercially available from the Shell Chemical Company, Houston, Tex.), 8 parts of a bismaleimide toughening agent (Compimide TM 121 commercially available from the Shell Chemical Company, Houston, Tex.), 37 parts calcium carbonate filler, and 29 parts dichloroethane. The substrate for this example was a 17.8 cm diameter, 0.6 millimeter thick, aluminum metal disc which had been etched in hot chromic/sulfuric acid. The make coat binder precursor was applied to the disc with a weight of approximately 120 grams/square meter. Next, approximately 560 grams/square meter of grade 50 alumina zirconia abrasive grains were drop coated into the make coat binder precursor. The resulting composite was heated for 30 minutes at 90° C. to drive off the dichloroethane, following which the composite was heated for 60 minutes at 177° C. in order to partially cure the bismaleimide resin. After the resulting composite had cooled, a size coat binder precursor, which was the same as the make coat binder precursor, was applied over the abrasive grains with a weight of 480 grams/square meter. The resulting composite was heated for 30 minutes at 90° C. to drive off the dichloroethane and then heated for 120 minutes at 190° C., 300 minutes at 210° C., and 300 minutes at 250° C. The resulting flexible abrasive article was tested according to the Disc Test Procedure and the results can be found in Table 1.

Example 2

The flexible abrasive article of Example 2 was made and tested in the same manner as Example 1 except for the following changes. The make and size coat binder precursors comprised 25 parts of a bismaleimide resin (Compimide TM 796 commercially available from the Shell Chemical Company, Houston, Tex.), 9 parts of a bismaleimide toughening agent (Compimide TM 123 commercially available from the Shell Chemical Company, Houston, Tex.), 37 parts calcium carbonate filler, and 29 parts dichloroethane. The abrasive grain coating weight was 600 grams/square meter and the size coat binder precursor coating weight was 520 grams/square meter.

Comparative Example A

A make coat binder precursor was prepared that comprised 48 parts of a 83% solids resol phenolic resin and 52 parts of calcium carbonate filler. The solvent for the phenolic resin was water. The make coat binder precursor was applied to the same metal substrate as in Example 1 with a weight of approximately 160 grams/-square meter. Next, approximately 690 grams/square meter of grade 50 alumina zirconia abrasive grains were drop coated into the make coat binder precursor.

The resulting composite was heated for 120 minutes at 88° C. to partially cure the phenolic resin. A size coat binder precursor, which consisted of 48 parts of a 78% solids resol phenolic resin and 52 parts of calcium carbonate filler, was applied over the abrasive grains with a weight of 310 grams/square meter. The resulting composite was heated for 120 minutes at 88° C. and then for 10 hours at 100° C. The resulting flexible abrasive article was tested according to the Disc Test Procedure, the results for which can be found in Table 1.

Disc Test Procedure

The flexible abrasive discs to be tested were mounted on a beveled aluminum back-up pad, which was attached to an air slide action grinder. The disc abraded the face of a 1.25 cm by 18 cm 1018 cold rolled steel (steel containing 0.18 weight percent carbon) workpiece. The disc was driven at 2100 rpm. The force between the disc and the workpiece was 6.8 kg. Each disc was used to grind 8 separate workpieces for 1 minute each. The initial cut (i.e., steel removed after one minute of grinding) and the final cut (i.e., steel removed during a subsequent one minute of grinding) are listed in Table 1 as a percent of the Comparative Example A. The total cut refers to the amount of steel removed during he initial one minute grinding period plus the final one minute grinding period. Average values are listed for the initial cut, final cut, and total cut.

TABLE 1

| Example | Initial Cut % | Final Cut % | Total Cut % |
|---|---|---|---|
| Comparative A | 100 | 100 | 100 |
| 1 | 101 | 233 | 139 |
| 2 | 95 | 210 | 121 |

Example 3

This example demonstrates the use of a flexible abrasive article containing a superabrasive grain (cubic boron nitride). A make coat binder precursor was prepared by thoroughly mixing at room temperature 24 parts of a bismaleimide resin (Compimide TM 796 commercially available from the Shell Chemical Company, Houston, Tex.) 11 parts of a bismaleimide curing agent (Compimide TM 121 commercially available from the Shell Chemical Company, Houston, Tex.), 37 parts calcium carbonate filler and 29 parts dichloroethane. The substrate for this example was a 17.8 cm diameter aluminum metal disc which had been etched in hot chromic/sulfuric acid. An annular ring 3.8 cm wide around the outer edge of the metal disc was coated with 0.75 grams of the make coat binder precursor. This was then followed by drop coating 6.5 grams of grade 80 to 100 nickel coated cubic boron nitride abrasive grains, that were previously etched in nitric acid, into the make coat. The resulting composite was heated for 30 minutes at 90° C. to drive off the dichloroethane and then the bismaleimide resin was partially cured for 60 minutes at 177° C. After the resulting composite had cooled, a size coat binder precursor, which was the same as the make coat binder precursor, was applied over the abrasive grains with a weight of 3.5 grams per the outer 3.8 cm. The resulting composite was heated for 30 minutes at 90° C. to drive off the dichloroethane and then heated for 120 minutes at 190° C., 300 minutes at 210° C., and 300 minutes at 250° C. The resulting flexible abrasive article was tested according to the Disc Test Procedure except that the workpiece was a hardened M2 tool steel. After 120 minutes of grinding, the flexible abrasive disc removed 171 grams of tool steel.

Procedure I for Making Fabric-Backed Coated Abrasive

A make coat, comprising 48% of a resole phenolic resin and 52% of CMS, was prepared. The make coat was diluted to 84% solids with a 90/10 solvent blend of water/ethylene glycol monobutyl ether acetate and applied to the front side of the backing with a wet weight of 220 g/m$^2$. Into the make coat was electrostatically coated 480 g/m$^2$ of grade 50 CAO. The resulting product was heated for 90 minutes at 90° C. Next, a size coat was applied over the abrasive grains/make coat with a wet weight of 390 g/m$^2$. The formulation of the size coat was the same as the make coat, except that the percent solids was 78%. The resulting product was heated for 90 minutes at 90° C., following which it Was heated at 10 hours at 100° C. After curing, the coated abrasive product was flexed prior to testing.

Procedure II for Making Fabric-Backed Coated Abrasive

A make coat comprising 33.1% of a bismaleimide resin (Compimide TM 796 commercially available from the Shell Chemical Co., Houston, Tex.), 14.9% of a bismaleimide curing agent (Compimide TM 121 commercially available from the Shell Chemical Co., Houston, Tex.) and 52% of CMS was prepared. The make coat was diluted with N-methyl pyrrolidone to 82% solids and was applied to the front side of the backing with a wet weight of 220 g/m$^2$. Into the make coat was electrostatically coated 480 g/m$^2$ of grade 50 CAO. The resulting product was heated for one hour at 120° C., one hour at 140° C., and 2 hours at 180° C.

Then a size coat was applied over the abrasive grains/make coat with a wet weight of 390 g/m$^2$. The formulation of the size coat was the same as the make coat, except that the size coat was 78% solids. The resulting product was heated for one hour at 120° C., one hour at 140° C., one hour 190° C., and then 14 hours at 220° C. in a vacuum oven. After curing, the coated abrasive product was flexed prior to testing.

Test Procedure I

The coated abrasive material was attached to 30 the periphery of a 36 cm diameter metal wheel, which rotated to produce a surface speed of 1677 meters/min. The effective cutting area of the abrasive segment was 2.54 cm by 109 cm. The workpiece consisted of three identical 1018 (plain carbon steel containing 0.18% carbon) steel bars measuring 1.27 cm wide by 36 cm long by 7.6 cm high positioned parallel to one another and separated by 1.27 cm wide gaps. Abrading was carried out on the 1.27 cm by 36 cm faces of the three steel bars. The workpiece was mounted on a reciprocating table which traversed at 18 meters/minute. At the end of each table stroke, the metal wheel was moved 1.27 cm perpendicular to the motion of the reciprocating table. This indexing of the wheel position was continued in the same direction until the abrasive material moved beyond the outside metal bar at which time the direction was reversed. On each direction reversal of this sideways wheel motion, the wheel was down fed 45.7 micrometers. This abrading process was conventional surface grinding wherein the workpiece was reciprocated beneath the rotating contact wheel with an incremental down feed taking place at the end of the feed cycle. The test endpoint was reached when all of the usable abrasive grain had been worn away from the surface of the coated abrasive. The amount of steel removed in each example was measured in grams. The amount of steel removed shown in the Test Tables represent an average of two or more tests. The grinding was carried out under a water flood. Prior to testing, all of the examples were soaked for 16 hours in 98° C. hot water.

Test Procedure II

Test Procedure II was essentially the same as Test Procedure I, except that there was no water soak in 98° C. hot water prior to testing.

Test Procedure III

Test Procedure III is essentially the same as Test Procedure II except that the downfeed was 61.0 micrometers.

Comparative Example B, C, and D and Example 4

This set of examples compares various coated abrasive constructions containing the thermosetting binder of the invention. The resulting coated abrasives were tested according to Test Procedures I and III and the results can be found in Table 2.

Comparative Example B

The coated abrasive for Comparative Example B was made according to "Procedure I for Making the Coated Abrasive". In this example the backing was a Y weight (285 g/m$^2$) woven polyester backing having a four over one weave. The backing was saturated with a latex-/phenolic resin and then placed in an oven to partially cure the resin. Next, backsize coat was applied to the backside of the backing and then heated to partially cure the resin. The backsize coat, which consisted of a latex/phenolic resin/calcium carbonate solution, was applied to the front side of the backing and heated to partially cure the resin. The backing was completely treated and was ready to receive the make coat.

Comparative Example C

The coated abrasive for Comparative Example C was made according to "Procedure I for Making the Coated Abrasive". In this example the backing was the same as Comparative Example B except that the backing contained a second backsize coat applied over the first backsize coat. The second backsize coat comprised 60% of a bisphenol A based epoxy resin (Epon TM 828 commercially available from the Shell Chemical Co., Houston, Tex.) and 40% of a polyamide curing agent (Versamid TM 125 commercially available from the Henkel Corp.). The second backsize coat was diluted with SOL to 50% solids prior to coating. The second backsize was applied with a coating wet weight of 78 g/m$^2$ and the cloth was heated for 2 hours at 90° C. to cure the epoxy resin.

Comparative Example D

The coated abrasive for Comparative Example D was made according to "Procedure I for Making the Coated Abrasive". In this example the greige cloth backing was a two over one weave of a 1000 denier aramid fiber in the warp direction and a 445 denier texturized polyester yarn in the fill direction and had a 38 by 27 thread count. The aramid fiber was purchased from Teijin Corporation under the trade designation Technora. A cloth treating solution was prepared that comprised 35 g of ER1, 65 g of HPT 1079, 21.6 g of Modifying Component A, 47.6 g of Modifying Component B, 3.0 g of an epoxy functional silicone glycol (X2-8419 commercially available from Dow Corning), and 3.0 g of a powdered silicone rubber (X5-8406 commercially available from Dow Corning). The above cloth treating solution was diluted to 79% solids with a 50/50 blend of butyl acetate and ethylene glycol monobutyl ether acetate. The greige cloth was saturated with the cloth treating solution with a wet weight of 220 g/m$^2$. The resulting cloth was heated for 20 minutes as the temperature increased from room temperature to 150° C. and then heated for 20 minutes at 150° C. Next, the cloth was presized via a knife coater by applying the cloth treating solution over the front side of the cloth with a wet weight of 160 g/m$^2$. The resulting cloth was heated for 15 minutes as the temperature was increased from room temperature to 150° C. and then heated for 5 minutes at 150° C. In an additional final step, after the coated abrasive product was made according to Procedure I, it received an additional one hour thermal cure at 180° C.

Example 4

The treated backing for Example 4 was the same as the treated backing of Comparative Example D. The remaining steps to make the coated abrasive were the same as "Procedure II for Making the Coated Abrasive".

TABLE 2

| TEST PROCEDURES I AND III | | |
|---|---|---|
| Example | Test Procedure I Total Steel Removed (g) | Test Procedure III Total Steel Removed (g) |
| Comparative B | 747 | 711 |
| Comparative C | 1133 | 1492 |
| Comparative D | 1630 | 930 |
| 4 | 2636 | 1272 |

Comparative Example E and Example 5

This set of examples demonstrated various aspects of the invention. The resulting coated abrasive articles were tested according to Test Procedure I, the results of which can be found in Table 3. Additionally, Comparative Example B and Example 5 were tested according to Test Procedure II, the results of which can be found in Table 4.

Example 5

The coated abrasive article of Example 5 was made according to the following procedure. The backing consisted of a greige cloth which had a two over one weave of a 20 denier aramid fiber in the warp and fill directions. The thread count was 100 by 52. This backing was purchased from Teijin under the style number MS0221. A saturant coat was prepared comprising 35.0 parts ER1, 65.0 parts HPT 1079, 57.3 parts PEI, and 72.0 parts Modifying Component A. The saturant coat was diluted to 71% solids with ethylene glycol monobutyl ether acetate solvent prior to coating. The greige cloth was saturated with this cloth treating solution with a wet weight of 388 g/m$^2$ and then heated for thirty minutes at 100° C., followed by 5 minutes at 150° C. A backsize coat was prepared that consisted of a 25% PEI and 75% N-methyl pyrrolidone. The cloth was then backsized with a wet weight of 200 g/m$^2$ using a knife coater. The treated cloth was then heated for 40 minutes at 100° C., followed by 20 minutes at 120° C., and 5 minutes at 150° C. The remaining steps followed to make the coated abrasive article were the same as for Procedure II for making the coated abrasive article except for the following changes. The make coat was 80% solids and the size coat was 76% solids. Additionally, the make coat consisted of 27% bismaleimide resin (Matrimid 5292 Part A commercially available from Ciba-Geigy), 21% bismaleimide curing agent (Matrimid 5292 Part B commercially available from Ciba-Geigy), and 52% of CMS. The size coat precursor wet weight was 450 g/m$^2$. After the size coat precursor was applied, the resulting coated abrasive article was heated for one hour at 120° C., followed by one hour at 150° C., one hour at 190° C., and 14 hours at 220° C. The 220° C. thermal cure was conducted under a vacuum.

Comparative Example E

The coated abrasive for Comparative Example E was made in the same manner as Example 5 except that the make coat, abrasive grain coat, and size coat were the same as those described in Procedure I for making the coated abrasive.

TABLE 3

| Test Procedure I | |
|---|---|
| Example | Total Steel Removed (g) |
| Comparative B | 805 |
| 5 | 3777 |
| Comparative E | 1721 |

The data contained in Table 3 demonstrates that the bismaleimide binder of the invention is an improved binder even under wet grinding conditions.

TABLE 4

| TEST PROCEDURE II | |
|---|---|
| Example | Total Steel Removed (g) |
| Comparative B | 1899 |
| 5 | 3996 |
| Comparative E | 6367 |

The data contained in Table 4 demonstrates that bismaleimide binder is a useful binder component for coated abrasives.

Example 6

The coated abrasive for Example 6 was made according to the following procedure. The backing consisted of a greige cloth which had a two over one weave of a 20 denier aramid fiber in the warp and fill directions. The thread count Was 100 by 52. This backing was purchased from Teijin under the style number MS0221. A cloth treating solution was prepared that consisted of 25% PEI and 75% N-methyl pyrrolidione. The greige cloth was saturated with this cloth treating solution with a wet weight of 217 g/m$^2$ and then heated for two hours at 120° C. Next, the resulting cloth was presized with the same cloth treating solution, using a knife coater, with a wet weight of 140 g/m$^2$. The treated cloth was then heated for one hour at 120° C., followed by two hours at 150° C. The remaining steps to make the coated abrasive was the same as that described in Procedure II for Making the Coated Abrasive.

Example 7

The coated abrasive for Example 7 was made and tested in the same manner as Example 6 except that the make and size coat precursors of Example 5 were employed.

TABLE 5

| TEST PROCEDURE I | |
|---|---|
| Example | Total Steel Removed (g) |
| Comparative B | 589 |
| 6 | 1183 |
| 7 | 1299 |

Examples 8 through 10 and Comparative Example F

Comparative Example F

The coated abrasive for this example was made in the same manner as Comparative Example B except that the abrasive grain was CAO$^2$.

Example 8

The coated abrasive fabric for this example was the same as Example 3. A saturant solution was prepared that consisted of 35 parts of ER1, 65 parts of HPT 1079, 97.8 parts of PEI, and 81.7 parts of Modifying Component C. This saturant solution was then diluted to 40% solids with a 90/10 1,2 dichloroethane/butyl acetate diluent. The fabric was saturated with this solution with a wet weight of about 280 g/m$^2$. Then the resulting fabric was heated for 30 minutes at 100° C., followed by 5 minutes at 150° C. Next, the saturated fabric was backsized with a solution that consisted of a 25% solids of PEI in N-methyl pyrolidinone diluent. The wet backsize weight was 64 g/m$^2$. The resulting construction was heated for 40 minutes at 100° C. and then 20 minutes at 120° C. The remaining steps to form the coated abrasive were the same as Comparative Example C except that the coated abrasive received an additional thermal cure of 2 hours at 180° C. prior to testing.

Example 9

The coated abrasive for Example 9 was made according to Procedure II for Making the Coated Abrasive except for the following changes. The abrasive grain was $CAO^2$. The backing for Example 9 was the same as that described in Example 8.

Example 10

The coated abrasive treated backing for Example 10 was the same as that in Example 8. The make coat, abrasive grain and size coat were applied in the same manner as Example 7. The abrasive grain used was $CAO^2$.

TABLE 6

| Example | Test Procedure I Total Steel Removed (g) | Test Procedure II Total Steel Removed (g) |
|---|---|---|
| Comparative F | 481 | 4078 |
| 8 | 805 | 3838 |
| 9 | 1511 | 5911 |
| 10 | 5352 | 8867 |

Various modifications and alterations of this invention will become apparent to those skilled in the art without departing from the scope and spirit of this invention, and should be understood that this invention is not to be unduly limited to the illustrated embodiments set forth herein.

We claim:

1. An abrasive article comprising:

(a) a flexible substrate having a front side and a back side;

(b) at least one layer of abrasive grains bonded to said front side of said substrate by means of a make coat;

(c) optionally one or more additional coats selected from the group consisting of a size coat, a supersize coat, a saturant coat, a presize coat, and a backsize coat;

wherein at least one of said make, size supersize, saturant, presize, and backsize coats comprises a cured maleimide binder.

2. The abrasive article of claim 1 wherein said maleimide binder comprises a cured precursor, wherein said precursor comprises a bismaleimide resin of the formula:

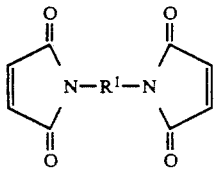

wherein $R^1$ comprises an organic group selected from the group consisting of aliphatic, cycloaliphatic, and aromatic groups.

3. The abrasive article of claim 1 wherein said maleimide binder comprises a cured precursor, wherein said precursor comprises a maleimide resin of the formula:

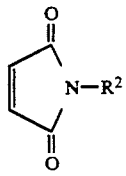

wherein $R^2$ is an organic group selected from the group consisting of aliphatic, cycloaliphatic, and aromatic groups.

4. The abrasive article of claim 1 wherein said maleimide binder comprises a cured precursor, wherein said precursor comprises a maleimide resin of the formula:

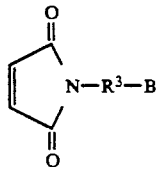

wherein $R^3$ is an organic group selected from the group consisting of aliphatic, cycloaliphatic, and aromatic groups; and B is a polymerizable group.

5. The abrasive article of claim 1 wherein $R^1$ is selected from the group consisting of:

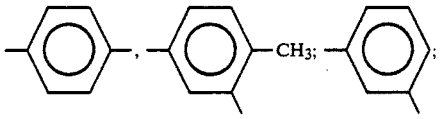

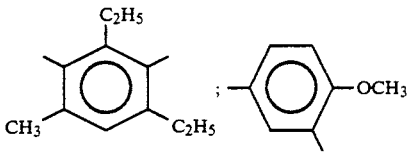

$(CH_2)_n$ where n is an integer of about 1 to about 20;

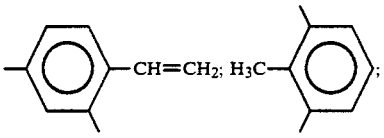

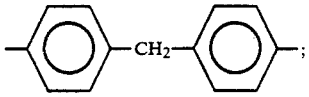

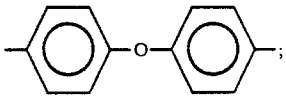

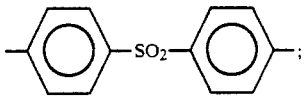

-continued
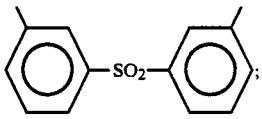
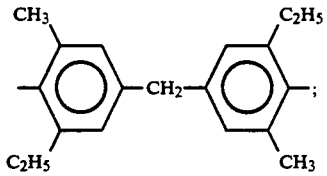
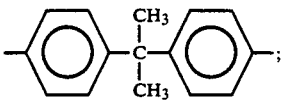
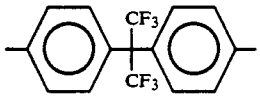
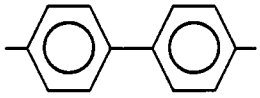
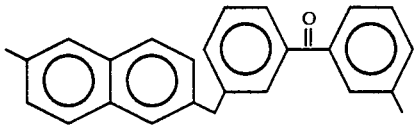
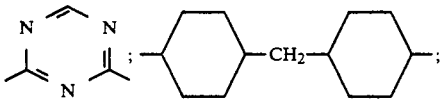
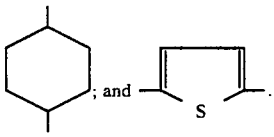
6. The abrasive article of claim 3 wherein $R^2$ is selected from the group consisting of:
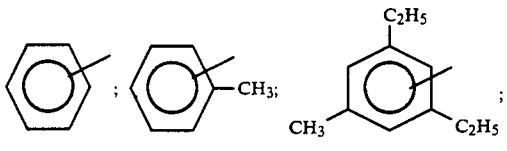
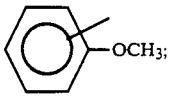
$(CH_2)_n$ where n is an integer of about 1 to about 20;
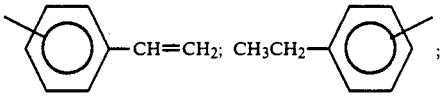
-continued
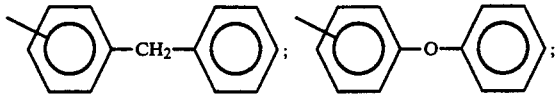
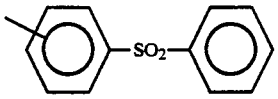
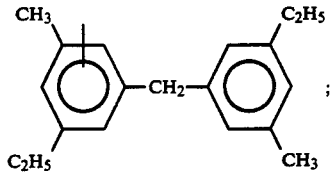
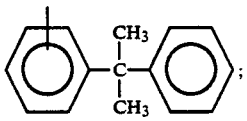
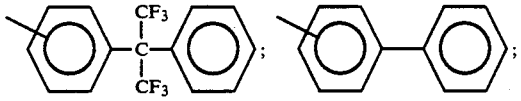
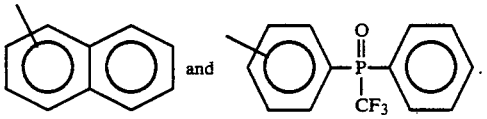
7. The abrasive article of claim 4 wherein $R^3$—B is selected from the group consisting of:
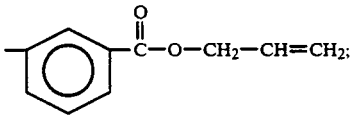
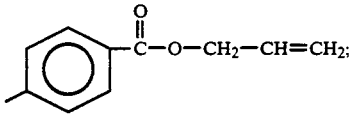
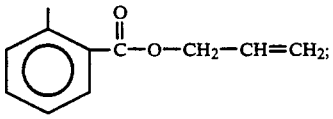
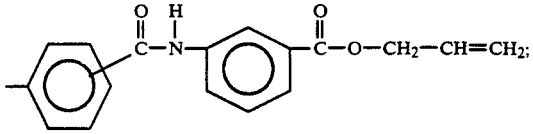
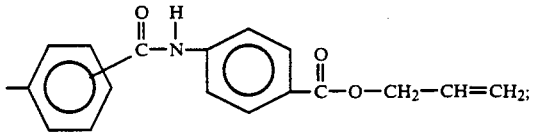

-continued

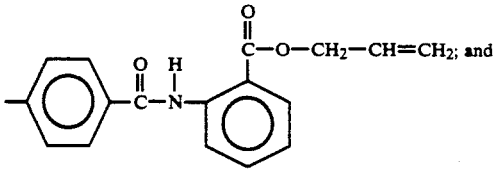

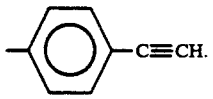

8. The abrasive article of claim 1 wherein the maleimide binder further comprises a resinous adhesive.

9. The abrasive article of claim 8 wherein said resinous adhesive is selected from the group consisting of phenolic resins, epoxy resins, urea-formaldehyde resins, acrylate resins, melamine-formaldehyde resins, polyamide resins, aminoplast resins, and mixtures thereof.

10. The abrasive article of claim 1 wherein said maleimide binder further comprises an additive selected from the group consisting of fillers, grinding aids, wetting agents, surfactants, toughening agents, plasticizers, dyes, pigments, coupling agents, and mixtures thereof.

11. The abrasive article of claim 1 wherein said flexible substrate is selected from the group consisting of paper, metallic plates having thicknesses of less than about 3 mm, cloth, nonwoven fibrous sheets, vulcanized fiber, polymeric films, combinations thereof, and treated versions thereof.

12. The abrasive article of claim 1 wherein said abrasive grains are selected from the group consisting of heat treated aluminum oxide, silicon carbide, alumina zirconia, ceria, garnet, diamond, boron carbide, cubic boron nitride, silicon nitride, and mixtures thereof.

13. The abrasive article of claim 1 wherein said abrasive grains are selected from the group consisting of diamond, cubic boron nitride, and mixtures thereof.

14. An abrasive article comprising:

(a) an open porous fibrous nonwoven substrate;

(b) a plurality of abrasive grains; and (c) a binder comprising a cured maleimide resin;

wherein the binder serves to bond the abrasives into and onto the fibrous nonwoven substrate.

15. The abrasive article of claim 14 wherein said maleimide binder comprises a cured precursor wherein said precursor comprises a bismaleimide resin of the formula:

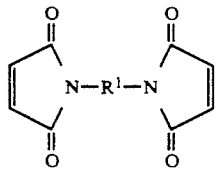

wherein $R^1$ comprises an organic group selected from the group consisting of aliphatic, cycloaliphatic, and aromatic groups.

16. The abrasive article of claim 14 wherein said maleimide binder comprises a cured precursor wherein said precursor comprises a maleimide resin of the formula:

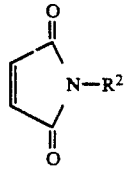

wherein $R^2$ is an organic group selected from the group consisting of aliphatic, cycloaliphatic, and aromatic groups.

17. The abrasive article of claim 14 wherein said maleimide binder comprises a cured precursor, wherein said precursor comprises a maleimide resin of the formula:

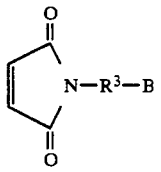

wherein $R^3$ is an organic group selected from the group consisting of aliphatic, cycloaliphatic, and aromatic groups;

and B is a polymerizable group.

18. A method of making an abrasive article comprising the steps of:

(a) coating a front side of a substrate having a front side and a back side with a make coat precursor;

(b) applying at least one layer of abrasive grains onto the make coat precursor;

(c) at least partially curing the make coat precursor by exposing the make coat precursor to an energy source;

(d) coating a size coat precursor over the abrasive grains and the at least partially cured make coat;

(e) curing the size coat precursor and the at least partially cured make coat, if needed, by exposure to an energy source in order to form a fully cured abrasive article;

wherein at least one of the make coat precursor and the size coat precursor comprises a maleimide binder.

19. The method of claim 18 wherein said make coat precursor is a liquid make coat precursor.

20. The method of claim 18 wherein said size coat precursor is a liquid size coat precursor.

* * * * *

UNITED STATES PATENT AND TRADEMARK OFFICE

CERTIFICATE OF CORRECTION

PATENT NO.: 5,314,513

DATED: May 24, 1994

INVENTOR(S): Philip Miller, Eric G. Larson, and Don H. Kincaid

It is certified that error appears in the above-identified patent and that said Letters Patent is hereby corrected as shown below:

Column 12, line 59, "ally" should read --allyl--.

Column 21, line 68, "I40°C" should read --140°C--.

Column 24, line 39, "it Was" should read --it was--.

Column 24, line 68, "to 30 the" should read --to the--.

Column 31, lines 28-33, " 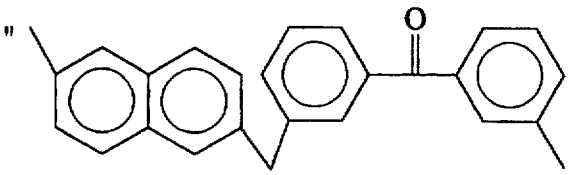 "

should read -- 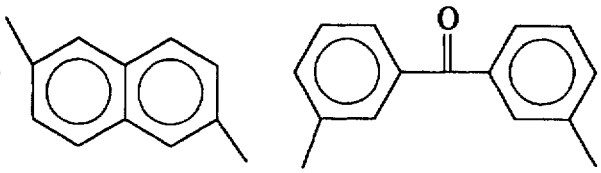 --.

UNITED STATES PATENT AND TRADEMARK OFFICE

CERTIFICATE OF CORRECTION

PATENT NO. : 5,314,513
DATED : May 24, 1994
INVENTOR(S) : Philip Miller, et. al.

It is certified that error appears in the above-indentified patent and that said Letters Patent is hereby corrected as shown below:

Column 33, lines 35, delete "heat treated aluminum oxide".

Signed and Sealed this

Twenty-third Day of September, 1997

*Attest:*

Bruce Lehman

BRUCE LEHMAN

*Attesting Officer*

*Commissioner of Patents and Trademarks*